US008814683B2

(12) United States Patent
Hollander et al.

(10) Patent No.: US 8,814,683 B2
(45) Date of Patent: Aug. 26, 2014

(54) GAMING SYSTEM AND METHODS ADAPTED TO UTILIZE RECORDED PLAYER GESTURES

(71) Applicant: WMS Gaming Inc., Waukegan, IL (US)

(72) Inventors: Evan Hollander, Buffalo Grove, IL (US); Joel Jaffe, Glenview, IL (US); Jesse Smith, Chicago, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 13/746,458

(22) Filed: Jan. 22, 2013

(65) Prior Publication Data

US 2014/0206442 A1 Jul. 24, 2014

(51) Int. Cl.
*A63F 9/24* (2006.01)

(52) U.S. Cl.
USPC ..... 463/31; 463/42

(58) Field of Classification Search
USPC ..... 463/31–42
See application file for complete search history.

(56) References Cited

U.S. PATENT DOCUMENTS

2001/0035087 A1 11/2001 Subotnick
2002/0178008 A1 11/2002 Reynar
2003/0159567 A1 8/2003 Subotnick
2005/0134578 A1 6/2005 Chambers et al.
2006/0052163 A1* 3/2006 Aida ..... 463/31
2006/0117067 A1 6/2006 Wright et al.
2006/0193509 A1 8/2006 Criminisi et al.
2007/0004510 A1 1/2007 Underdahl et al.
2007/0233740 A1 10/2007 Nichols et al.
2007/0259716 A1 11/2007 Mattice et al.
2007/0259717 A1 11/2007 Mattice et al.
2007/0283265 A1 12/2007 Portano
2008/0016467 A1 1/2008 Chambers et al.
2008/0016468 A1 1/2008 Chamber et al.
2008/0020827 A1 1/2008 Underdahl et al.
2008/0040692 A1 2/2008 Sunday et al.
2008/0146302 A1* 6/2008 Olsen et al. ..... 463/7
2009/0143141 A1 6/2009 Wells et al.
2009/0172606 A1 7/2009 Dunn et al.
2009/0187824 A1 7/2009 Hinckley et al.
2009/0191946 A1 7/2009 Thomas et al.
2009/0270170 A1* 10/2009 Patton ..... 463/36
2009/0315740 A1 12/2009 Hildreth et al.
2009/0318168 A1 12/2009 Khosravy et al.
2009/0319181 A1 12/2009 Khosravy et al.
2010/0130280 A1 5/2010 Arezina et al.
2010/0234094 A1 9/2010 Gagner et al.
2010/0281436 A1 11/2010 Kipman et al.
2010/0289743 A1 11/2010 Sun et al.
2010/0306685 A1 12/2010 Giaimo, III et al.
2011/0006977 A1 1/2011 Khosravy et al.
2011/0010676 A1 1/2011 Khosravy et al.
2011/0063224 A1 3/2011 Vexo et al.
2011/0126135 A1 5/2011 Chambers et al.

(Continued)

*Primary Examiner* — Masud Ahmed
(74) *Attorney, Agent, or Firm* — Nixon Peabody LLP

(57) ABSTRACT

A method of utilizing a player's movements in association with a wagering game event, includes sensing a player's movements using a movement sensing device, storing a representation of the player's movements in non-transient computer-readable storage media in association with player-identifying information, associating the representation of the player's movements with the wagering game event in the storage media, and replaying the representation of the player's movements on one or more display devices operatively associated with a wagering game machine responsive to an occurrence of the wagering game event.

25 Claims, 5 Drawing Sheets

(56) References Cited

U.S. PATENT DOCUMENTS

2011/0165923 A1* 7/2011 Davis et al. ..... 463/1
2011/0173530 A1 7/2011 Winternitz et al.
2011/0223993 A1* 9/2011 Allen et al. ..... 463/30
2011/0306416 A1 12/2011 Kelly et al.
2012/0035924 A1 2/2012 Jitkoff et al.
2012/0035932 A1 2/2012 Jitkoff et al.
2012/0069131 A1 3/2012 Abelow
2012/0092286 A1 4/2012 O'Prey et al.
2012/0110516 A1 5/2012 Tumanov
2012/0131513 A1 5/2012 Ansell
2012/0131514 A1 5/2012 Ansell et al.
2012/0133579 A1 5/2012 Prieur et al.
2012/0144348 A1 6/2012 Stone-Perez et al.
2012/0169646 A1 7/2012 Berkes et al.
2012/0192121 A1 7/2012 Bonnat
2012/0218423 A1 8/2012 Smith et al.
2012/0239642 A1 9/2012 Bliss et al.
2012/0240043 A1 9/2012 Hinckley et al.
2012/0268369 A1 10/2012 Kikkeri
2012/0304059 A1 11/2012 McCloskey
2012/0322527 A1 12/2012 Aoki et al.
2013/0031517 A1 1/2013 Freeman et al.
2013/0033525 A1 2/2013 Markiewicz et al.
2013/0044141 A1 2/2013 Markiewicz et al.
2013/0053007 A1 2/2013 Cosman et al.
2013/0061180 A1 3/2013 Dongen et al.
2013/0067392 A1 3/2013 Leonard et al.
2013/0097644 A1 4/2013 Brande et al.
2013/0132856 A1 5/2013 Binyamin et al.
2013/0169560 A1 7/2013 Cederlund et al.
2013/0171607 A1 7/2013 Markiewic et al.
2013/0198690 A1 8/2013 Barsoum et al.
2013/0201276 A1 8/2013 Pradeep et al.
2013/0254066 A1 9/2013 Amacker et al.
2013/0254646 A1 9/2013 Amacker et al.
2013/0254647 A1 9/2013 Amacker et al.
2013/0254648 A1 9/2013 Amacker et al.
2013/0267317 A1 10/2013 Aoki et al.
2013/0274012 A1 10/2013 Aoki et al.
2013/0274016 A1 10/2013 Gagner et al.
2013/0281188 A1 10/2013 Guinn et al.
2013/0281189 A1 10/2013 Gagner et al.
2013/0296057 A1 11/2013 Gagner et al.
2013/0316316 A1 11/2013 Flavell et al.
2013/0316818 A1 11/2013 Earley et al.
2013/0321346 A1 12/2013 Tyler et al.
2013/0324220 A1 12/2013 Dicillo et al.
2013/0325673 A1 12/2013 Abdie et al.
2013/0326430 A1 12/2013 Devi et al.
2013/0331184 A1 12/2013 Kelly et al.
2013/0337889 A1 12/2013 Gagner et al.
2013/0344961 A1 12/2013 Iannetta
2013/0346843 A1 12/2013 Murray et al.
2014/0018166 A1 1/2014 Guild et al.
2014/0033134 A1 1/2014 Pimmel et al.
2014/0051499 A1 2/2014 Hamlin et al.
2014/0051500 A1 2/2014 Anderson et al.
2014/0066178 A1 3/2014 Kelly
2014/0066198 A1 3/2014 Robbins et al.
2014/0073386 A1 3/2014 Aoki et al.
2014/0075393 A1 3/2014 Mei et al.
2014/0080593 A1 3/2014 Rivera et al.
2014/0094241 A1 4/2014 Guinn et al.
2014/0094256 A1 4/2014 Hilbert et al.
2014/0094274 A1 4/2014 Guinn et al.
2014/0100030 A1 4/2014 Burke et al.

* cited by examiner

GAMING SYSTEM AND METHODS ADAPTED TO UTILIZE RECORDED PLAYER GESTURES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to gesture sensing systems and methods that sense a gesture or gestures made in a volumetric space and integrate such gesture or gestures into a wagering game presentation.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a system for utilizing a player's movements in association with one or more wagering game events is provided and comprises one or more movement sensing devices configured to sense a player's movements, one or more controllers configured to cause the one or more movement sensing devices to sense a player's movements and further configured to store a representation of the player's movements in one or more non-transient computer-readable storage media in association with both player-identifying information and the one or more wagering game events, to retrieve the stored representation of the player's movements from the one or more non-transient computer-readable storage media responsive to an occurrence of the one or more wagering game events and to display the stored representation of the player's movements on one or more display devices responsive to the occurrence of the one or more wagering game events.

According to another aspect of the invention, a computer-implemented method of utilizing a player's movements in association with a wagering game event includes sensing a player's movements using a movement sensing device, storing a representation of the player's movements in non-transient computer-readable storage media in association with player-identifying information, associating the representation of the player's movements with the wagering game event in the storage media, and replaying the representation of the player's movements on one or more display devices operatively associated with a wagering game machine responsive to an occurrence of the wagering game event.

According to yet another aspect of the invention, one or more physical machine-readable storage media including instructions which, when executed by one or more processors, cause at least one of the one or more processors to perform operations including causing one or more movement sensing devices operatively associated with at least one of the one or more processors to sense a player's movements and causing at least one of the one or more processors to store a representation of the player's movements in one or more non-transient computer-readable storage media in association with player-identifying information. The one or more physical machine-readable storage media further includes instructions which, when executed by one or more processors, associate the player's movements with a wagering game event in at least one of the one or more non-transient computer-readable storage media for subsequent replay of the representation of the player's movements on one or more display devices operatively associated with a wagering game machine responsive to an occurrence of the wagering game event.

Additional aspects of the invention will be apparent to those of ordinary skill in the art in view of the detailed description of various embodiments, which is made with reference to the drawings, a brief description of which is provided below.

Figure 1:
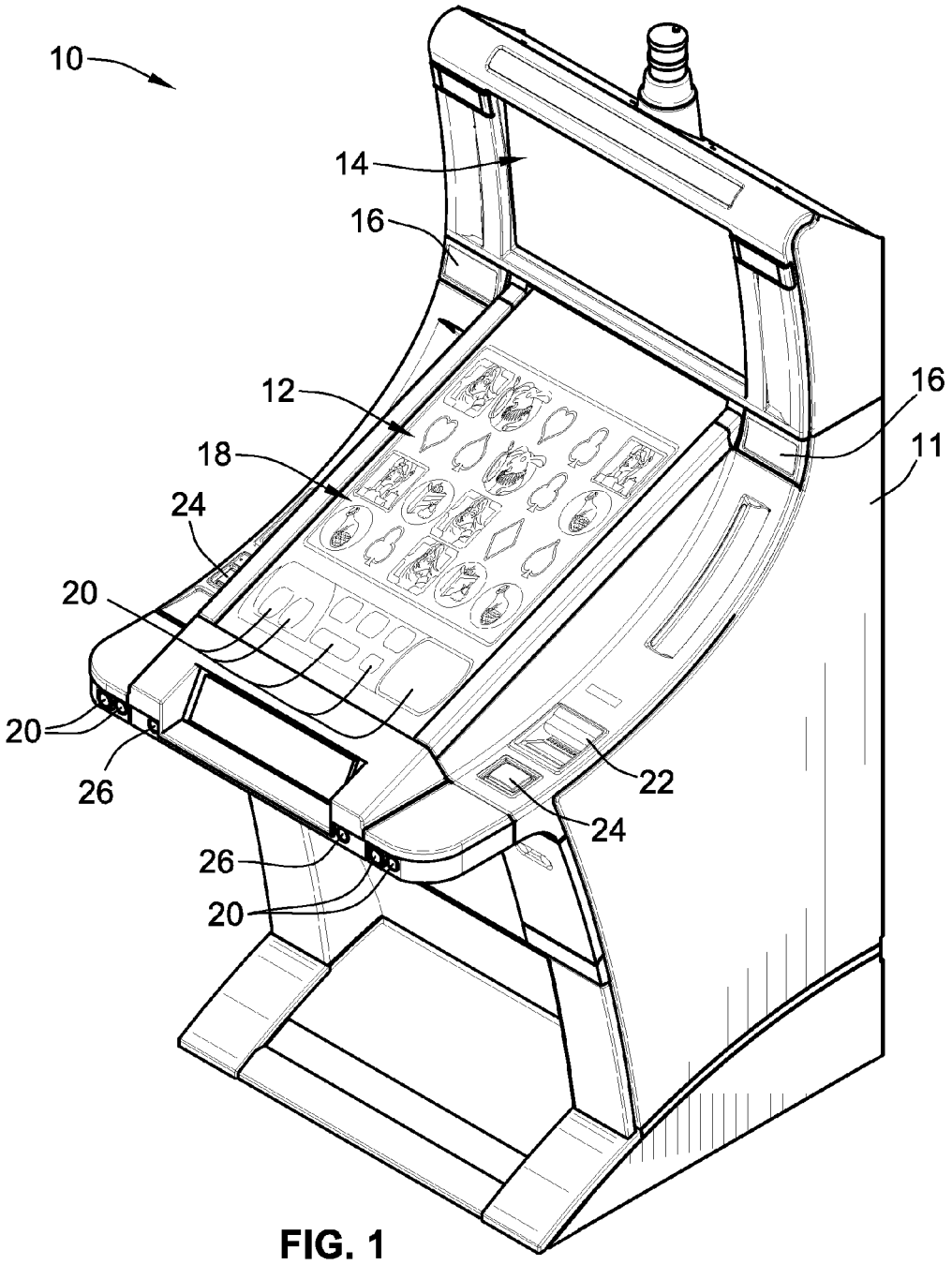
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
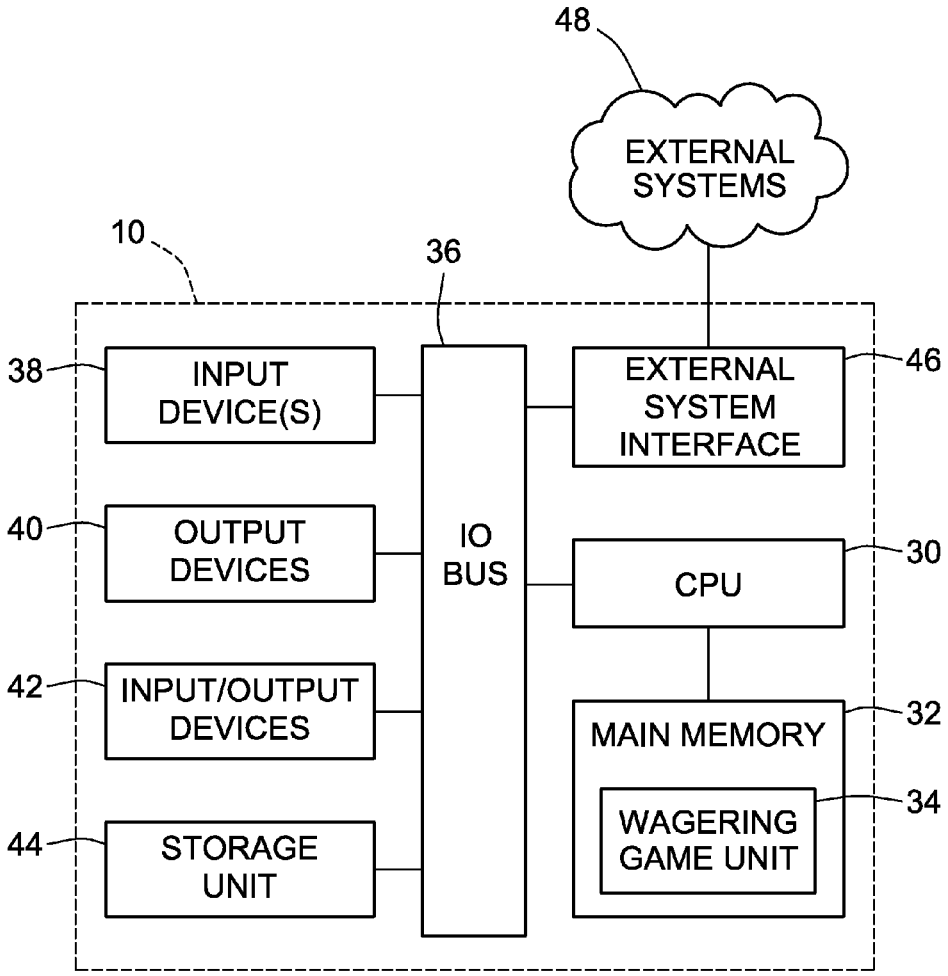
FIG. 2 (PRIOR ART)
FIG. 2 is a block diagram view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations connected directly or via a network. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 3:
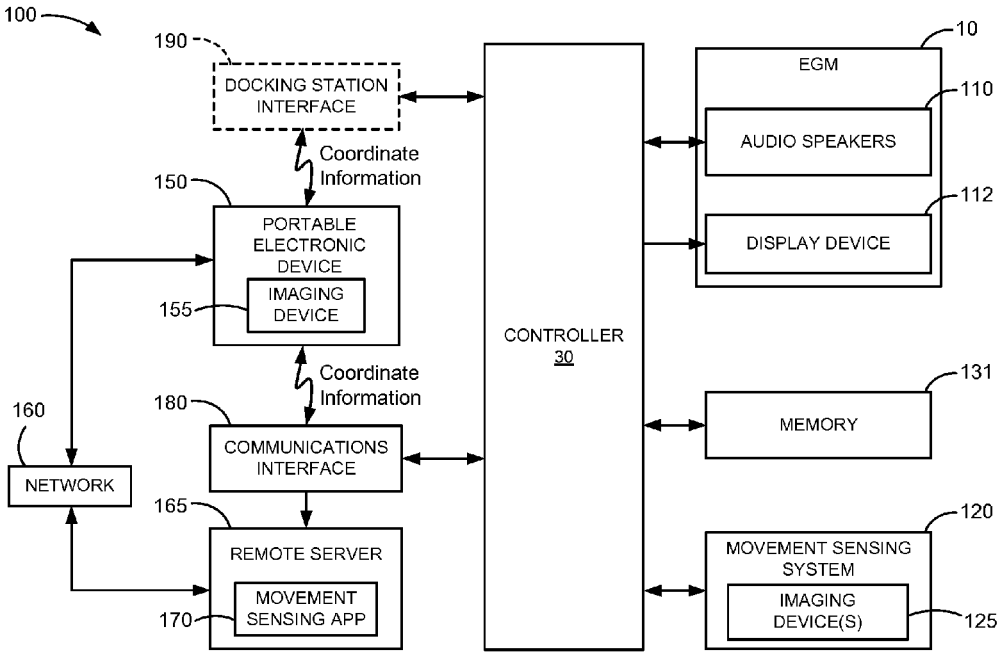
FIG. 3 is a functional block diagram of a system configured to sense gestures according to at least some aspects of the present disclosure.
Figure 4:
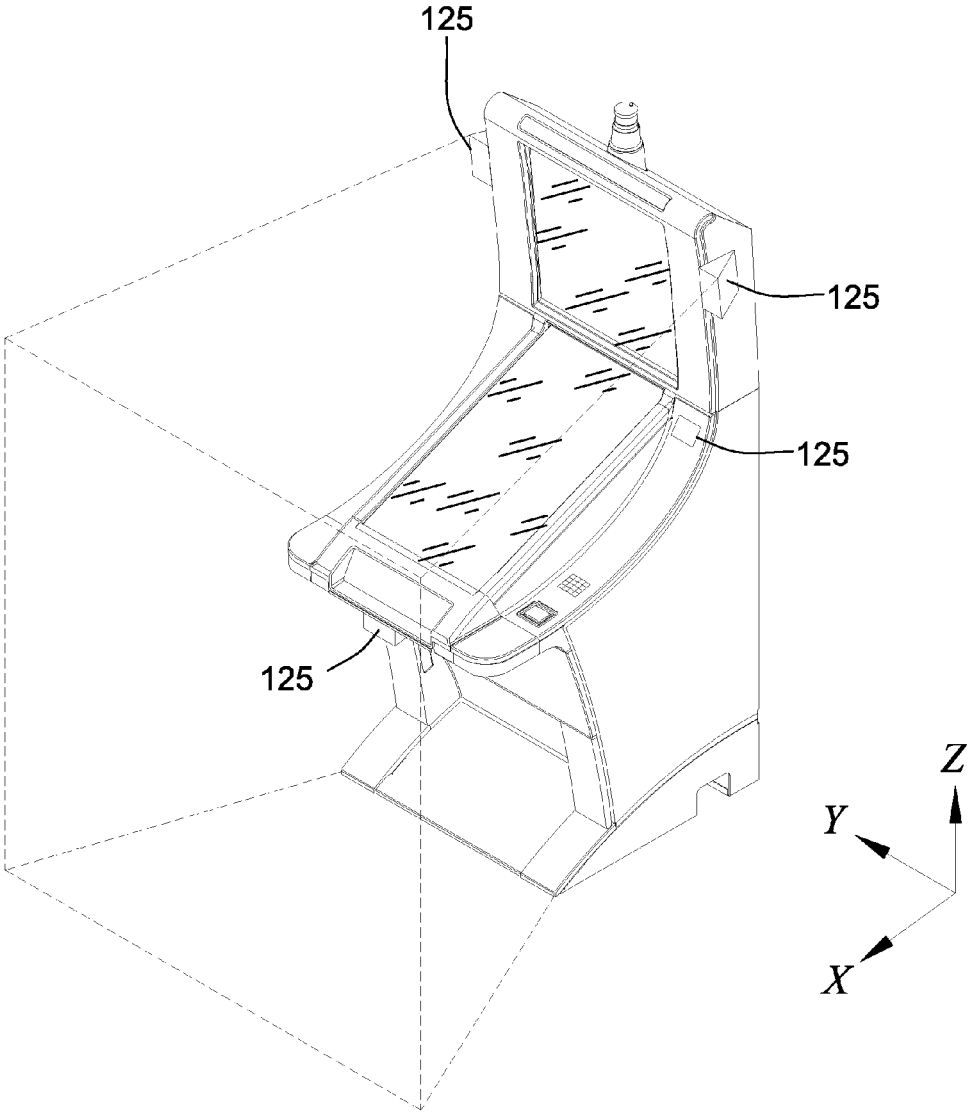
FIG. 4 is a perspective view of an example of a gaming terminal configured to sense player movements in a volumetric space in front of the gaming terminal according to at least some aspects of the present disclosure.

Referring now to FIG. 3, which shows a block diagram of a system 100 according to at least some aspects of the present disclosure wherein the system is configured to sense a player's movements using one or more local movement sensing devices 120, 125 or one or more remote movement sensing devices 150, 155, and one or more controllers 30 operatively associated with the movement sensing devices. The controller (s) 30 store a representation of the player's movements in non-transient computer-readable storage media (not shown) in association with both player-identifying information and one or more wagering game events, as discussed below. The controller(s) 30 retrieve the stored representation of the player's movements from the non-transient computer-readable storage media responsive to an occurrence of the one or more wagering game events and display the stored representation of the player's movements on one or more display devices 112 responsive to the occurrence of the one or more predetermined wagering game events. As shown, the system 100 depicted in FIG. 3 comprises a wagering game machine 10, such as is shown by way of example in FIG. 1, including audio speakers 110 over which a stored audio track corresponding to the sensed player's movements may be played contemporaneously with the display of the stored representation of the player's movements on the display device(s) 112. The audio track may comprise, for example, sound recorded contemporaneously with the sensing of the player's movements and stored in association with the storing of the representation of the player's movements. FIG. 4 is a perspective view of an example of a gaming terminal configured to sense player movements in a volumetric space, the volumetric space being represented for illustrative purposes by dashed lines, in front of the gaming terminal according to at least some aspects of the present disclosure.

The local movement sensing devices 120, 125 are disposed in, on or near the wagering game machine 10 to sense the movements of a player at the wagering game machine. In contrast, the remote movement sensing device(s) 150, 155 are not disposed in, on or near the wagering game machine 10, but rather may be disposed at any other fixed or mobile location. The controller 30 is not limited to a wagering game terminal controller and may include more than one controller, such as but not limited to a controller in an electronic device remote from a wagering game terminal or a plurality of distributed controllers (e.g., such as in a client-server architecture where the client and the server each has a controller). Different controllers can be responsible for handling different functions according to the aspects described herein.

According to at least some aspects of the present concepts, a gross or fine gesture or movement (e.g., movement of facial muscles, fingers, head, arms, legs, torso and/or body, etc.), or a series of gross or fine gestures or movements, are made in a volumetric space (hereinafter "movements" for brevity), either at a wagering game terminal 10 or remote from the wagering game terminal. The imaging device(s) 125, 155 of the movement sensing system(s) 120, 150 can include, by way of example, a digital video camera, for example, or a sensing technology such as the SoftKinetic® system having a DepthSense camera available from Softkinetic International of Brussels, Belguim, a PrimeSense natural interaction 3D machine-vision system available from PrimeSense, Ltd., a Kinect motion-sensing input device available from Microsoft Corporation, a 3-D scanner, a 3D time-of-flight camera, a CMOS-based 3D time-of-flight camera, a LIDAR device, a stereo digital camera, a Leap Motion sensor from Leap Motion, Inc. (www.leapmotion.com), a CCD camera configured to capture 2-D images, an IR camera, an IR video camera, and/or a video capture device, singly or in various combinations, hereinafter collectively and generally referred to as an "imaging device" or "movement sensing device". The components and functionality of these conventional systems are incorporated herein by reference in their entirety. The particular details of the structures involved in sensing movements in a volumetric space and converting those sensed movements to corresponding computer-readable data are not salient features of the present disclosure.

An example of a 3D-motion capture application is available from or can be based on a technology referred to as XTR3D by Extreme Reality, Ltd. based in Herzlia Pituah, Israel. Motion capture applications that could be utilized in accord with at least some aspects of the present concepts include all manner of conventional optical motion capture (MOCAP) systems (e.g., PhaseSpace of San Leandro, Calif., iPi Desktop Motion Capture™, systems using passive markers, active markers, time-modulated active markers, semi-passive imperceptible markers, markerless, etc.) as one presently preferred aspect, but do not exclude and could include, alone or in combination with optical MOCAP systems, motion capture suits, hand and facial MOCAP, RF positioning and/or magnetic MOCAP. As a further example, the DepthSense 325 (DS325) system, developed by SoftKinetic®, utilizes a small camera that sees both in 3D (depth—QVGA resolution) and high-definition 2D (color—720p) that enables high-quality finger and hand tracking, combined with HD video and dual microphones. The Depth Sense 311 (DS311), which utilizes a time-of-flight (TOF) 3D camera that combines a RGB sensor (VGA), a depth sensor (QQVGA) and microphones.

The movements are captured by the imaging device(s) 125, 155 and are stored in a local, non-transient computer-readable memory device(s) (e.g., 32) and/or a remote, non-transient computer-readable memory device(s) (e.g., 131) for communication, via a communications interface (e.g., 46 in FIG. 2 or 180 in FIG. 3), to the wagering game controller 30 for use in connection with a wagering game. The local and/or remote memory device(s), which may reside in a server (e.g., external systems 48 in FIG. 2) local to or remote from a user's electronic device(s) 150 (e.g. a digital camera, a home computer, a personal game console, etc.) used to sense and/or store a representation of the movements or a wagering game machine 10.

Device(s) configured to capture the user's movements in accord with the present concepts may utilize any conventional application, software, firmware and/or hardware enabling 2-D and/or 3-D movement sensing (fine and/or gross) and capture. In one example, a regular camera (e.g., a CCD camera) is configured to capture motion in the form of a silhouettes and depth information is not required or utilized. In another example, depth information is used (e.g., a Kinect system) and a representation of the player's movements in 3-D can be realized. In accord with aspects of the present concepts, a user downloads movement sensing software to his or her personal computer, tablet computer, or cellular phone via a network 160, such as a data cellular network, from a server or service to the portable electronic device. The movement sensing software enables him or her to then capture movement(s) for later utilization in combination with a wagering game machine 10. The user records the desired movement(s) (and optionally audio) using the user's portable electronic device 150 and the motion sensing software application and transmits the recorded movements to the controller 30 (e.g., via network 160 and communication interface 180 for external systems 48). This transmission of recorded movements from the user's portable electronic device 150 may occur either locally, in the vicinity of the wagering game machine(s) 10 and/or controller, or remotely therefrom.

As noted above, a movement sensing system 120 can advantageously be deployed at a wagering game machine 10 and may include imaging or sensing devices include technology such as a Softkinetic system having a DepthSense® camera available from Softkinetic International SA/NV, PrimeSense natural interaction 3D machine-vision system available from PrimeSense, Ltd., or Kinect motion-sensing input device available from Microsoft Corporation. The components and functionality of these conventional systems are incorporated herein by reference in their entirety.

In some, but not all, aspects, the system 100 can include a docking station interface 190 that interfaces, either by an electro-mechanical connector or wirelessly, a portable electronic device 150 with the gaming terminal 10. When the docking station interface 190 includes a connector, the gaming terminal 10 is advantageously configured to hold the portable electronic device 150 relative to the wagering game machine 10.

In accord with the above, a player is able to record movements either in advance of going to a casino, using one or more of their own devices (e.g., a webcam, cell phone, gaming platform, such as a PlayStation PS3 or Xbox 360, or some other movement detection device), or at a casino (e.g., at a wagering game machine). The system 100, either autonomously or in combination with player input(s), associates these movements, or a representation thereof, with one or more wagering game events. In one aspect, the one or more wagering game events are events selected by the player, such as through a selection screen on a wagering game machine display presenting the player with a plurality of options. In another aspect, the one or more wagering game events are events selected by the controller 30 rather than being selected by a player. In this latter aspect, the controller 30 may associate the player's movement(s) with an occurrence of a specific wagering game event occurring on the wagering game machine display such as, but not limited to, a first win event (e.g., a "win celebration"). The controller 30 may then later associate another of the player's movement(s) with an occurrence of another specific wagering game event occurring on the wagering game machine display, such as a second win event different than the first win event. In this way, a player may have different movements associated with different win events. Thus, whether prompted by a wagering game event or by a player input(s), the system 100 in accord with at least some aspects of the present concepts permits a variety of different player movements to be associated with a correspondingly plurality of wagering game events. In another variant, one player's movement or related series of movements are associated with a plurality of wagering game events.

Similarly, for the same wagering game events, a second player may have different movements associated with the wagering game events than a first player. For example, an avatar for a first player may have a different win celebration recorded movements that it uses when the win occurs that for a second player.

As to the representation of the player's movement, the representation may comprise unaltered video, one or more unaltered images (e.g., a series of still images taken over a short period of time), altered video, one or more altered images, animation, computer-generated imagery, or any combination thereof, with or without audio tracks. Accordingly, player's movement(s) using a Kinect (e.g., Xbox 360-based or PC-based) and transmitted to a wagering game system 100 are devolved into a skeletonized construct adaptable to further visual modification such as, but not limited to, integration into a selected avatar or virtual actor physique. Thus, the player's movements are translatable, in the wagering game system, into movements of a player-selected avatar, virtual actor or computer-generated character.

The player's movement need not be gross or large movements. Instead, the player's movement(s) may be fine or small movements, such as a smile or a lifting of an eyebrow or other facial movements that are expressive of an emotion.

The wagering game event may comprise any wagering game event in which the player is not interacting with the wagering game via player inputs. For example, the wagering game event may comprise one or more winning outcome event displays. In another aspect, the wagering game event could be something as mundane as the spinning of the reels. By way of example, a player's avatar could represent an emotion and/or stature presented by the player at any given moment at the wagering game machine 10 to mirror the player's behavior. Thus, the movement sensing system 120 of the wagering game machine 10 is activated by the system 100 responsive to the player's gestures, attitude, or demeanor at any given moment or moments while the player is watching the reels spin, in anticipation of an outcome display. The system 100 can then display on one or more display devices an avatar or computer-generated representation of the players gestures, attitude, or demeanor (e.g., the avatar is shown at the side of the reels looking toward the reels). Accordingly, in various aspects of the present concepts, the system 100 can store a plurality of player's movement(s) and selectively associate those player's movement(s) with a single wagering game event (e.g., spinning wheels may be associated with a plurality of different avatar expressions and/or vocalizations).

In another example, a player playing a game as part of a group with other players (e.g., a cooperative play game, a competitive play game, etc.) in a wagering game, or potentially in a non-wagering game, is able to select their personal-movement-based actor or avatar to appear on a winner's screen presented on one or more display devices (e.g., on only the winner's display(s), on the displays of all participating players, on an area display, etc.), such as in a winner's celebration, to announce the player's status following completion of the game. Likewise, aside from a winner's celebration, following completion of game play in a group game, one or more personal-movement-based actors or avatars may be displayed in sequence or in parallel to visually (and optionally auditorily) represent contributions of one or more players during the prior game or games (e.g., in a leaderboard-type display). By way of example, a winner's avatar is followed sequentially by the second-place player's avatar and the third-place player's avatar or, alternatively, the first through third player's avatars are all shown together.

In yet another example, the wagering game event to which a player's movement is associated is a bonus game event. For example, a player's avatar is walking along a path (e.g., WMS Gaming's The Lord of the Rings™ wagering game machine) and, if the player's avatar encounter something or achieve something (e.g., a player picks something that happens to be a top award for a given group of selectable elements), the player's avatar can then execute movements (e.g., jumping up and down) that has already recorded and saved in association with the player for such wagering game event. Likewise, other movements can be associated with other selectable elements (e.g., slumped shoulders or finger snap if the player picks the lowest-value selectable element in a pick field). Thus, by way of example, the player's movements (e.g., body movements, head movements, gestures, gesticulations, posture, etc.) may be represented in the wagering game or simply displayed on one or more displays for or during wagering game events including, but not limited to, bonus characters, bonus triggering events, win celebrations, near misses, spinning the reels, different-sized wins, etcetera. By way of example, a bonus triggering event may depict a player's avatar (or a computer-generated character) throwing an object, such as a ball or a dart, at a displayed selectable element (e.g., a target), and the player's pre-stored representations of such pre-defined movements are applied to the player's avatar or computer-generated character. In this way, in lieu of a "stock" graphic of a computer-generated character throwing a ball, a player's pre-stored movements associated with a ball throwing movement (e.g., a windup and throw) are used by the computer-generated player.

The player's movement(s) may also be sensed or imaged and stored for other representations. By way of example, the imaging devices 125 of the movement sensing system 120 captures video of the player picking up his or her phone and putting it to his or her ear. The avatar might then also be displayed to pick up a phone and put it to his or her (or its) ear in a mimic of the player. In general, the imaging devices 125 are configured in at least some aspects of the present concepts to sense and record player movements to teach the player's on-line avatar the player's mannerisms to permit personalized adjustments to the player's avatar over time using such recording of the player movements, or representations thereof, to associate one or more movements with one or more events before, during or after the wagering game. Of course, such avatar representations thereof are not necessarily limited to operation during a wagering game and may operate outside of the wagering game (e.g., appearing on the display between wagering games).

In another example, using the above-noted example of a player's avatar walking along a path (e.g., WMS Gaming's The Lord of the Rings™ wagering game machine) and encountering a group of selectable elements. In additional to the traditional awarding of whatever award is associated with the selectable element, one or more selectable elements may also be operatively associated with non-monetary avatar-centric awards that could enhance either player's avatar or provide an enhancement in a representation of, or function performed by, the avatar in a later game. By way of example, the non-monetary avatar-centric award could be cosmetic, such as unlocked wardrobe items, accoutrements, or the like. In other aspects, the non-monetary avatar-centric award could comprise an inventory item borne by the player's avatar, such as, a sword the avatar holds, a ring the avatar wears, a light the avatar holds, etcetera. In some aspects, such items borne by the avatar could optionally influence game play presentation, such as unlocking differing scenes in a bonus round corresponding to the avatar's inventory item(s) (e.g., a player's avatar having a sword unlocks one scene, whereas a player's swordless avatar unlocks a different scene, a player's avatar having a torch unlocks one scene, whereas a player's torchless avatar unlocks a different scene, etc.). The inventory items need not be displayed on or about the player's avatar.

The player's movement(s) are not stored as permanent game data, but are rather uploaded from the non-transient computer-readable storage media, wherever located (e.g., 32, 131, etc.), and used by the controller 30 in the wagering game as session-based data.

Further to the above, over time, a library of movements can be associated with a player and, responsive to an occurrence of a particular wagering game event, a controller 30 can select (e.g., sequentially, randomly, etc.) one of the player's movements to utilize for a given occurrence of the particular wagering game event.

More generally, over time, a library of movements can be associated with a player and, responsive to an occurrence of any wagering game event, a controller 30 can select (e.g., sequentially, randomly, etc.) one of the player's movements to utilize for any wagering game event. Thus, although at least some examples herein correlate or associate specific movement(s) of the player, or representations thereof, to a specific wagering game event, there need not be any such correlation or association and the controller 30 may simply randomly or pseudo-randomly select a player's movement(s) for expression responsive to a wagering game event.

In yet other aspects, a player having a plurality of movements associated with the player is able to select different such movements to apply not only to different wagering game events, but also or alternatively to different avatars so that, depending upon an avatar selected by a player, the movements for a specific wagering game event may vary. In other words, a first avatar selected by a player can show a representation of a player's first movement responsive to a first wagering game event (e.g., a win event of a first level), whereas a second avatar selected by the player can show a representation of the player's second movement responsive to the first wagering game event (the win event of a first level). Thus, the player can have different representations of recorded movements for each type of avatar selected by the player.

Further, where an avatar is used in accord with the present concepts, the avatar(s) can each have a personality that can be used to modify the player's movement(s), or representation thereof. For example, in response to a player's movements responsive to a wagering game event, the player's movement (s) are the player's movement(s) or a representation thereof are sensed and recorded for use in a subsequent occurrence of the wagering game event. However, upon the subsequent occurrence of the wagering game event, the avatar modifies the recorded player's movement(s) to present an adaptation of the player's movement(s), as influenced by the personality of the avatar.

In other aspects, device(s) configured to capture the user's movements in accord with the present concepts may utilize any conventional application, software, firmware and/or hardware enabling 2-D and/or 3-D movement sensing and capture, disposed in a gaming machine (e.g., a wagering game machine) or disposed externally to a gaming machine, to capture a player's motion(s) and verbalization(s) and store it in a library for insertion into a game conducted on the gaming machine. Thus, the game graphics may comprise portions where a substitute graphic, if available from a pre-stored player library, can be utilized in place of a stock graphic presentation. In support of this capability, a player desiring to populate a library of movements particular to a particular game may record one or more movements (e.g., a sequence of movements) that could be accessed by the game system and inserted into selected portions of game play. Such recording may optionally include the display of instructions to the player (e.g., displayed textual instructions, displayed graphical instructions, audio instruction, etc.) as to general movements, situations and/or emotions that should be captured by a player's movements to facilitate utilization in a particular game. By way of example, rather than the player's avatar performing a selected movement, the computer character in the game would perform the selected movement (e.g., player-selected or computer-selected). The library may advantageously separate movements into classes of movements (e.g., jumping, crouching, walking, kicking, hitting, gestures, etc.) to facilitate selection in a particular game state. For example, where a player selects movements for utilization by a computer generated character in a game, the computer may request that the character select from the player's library a sequence of walking, jumping, and kicking.

Figure 5:
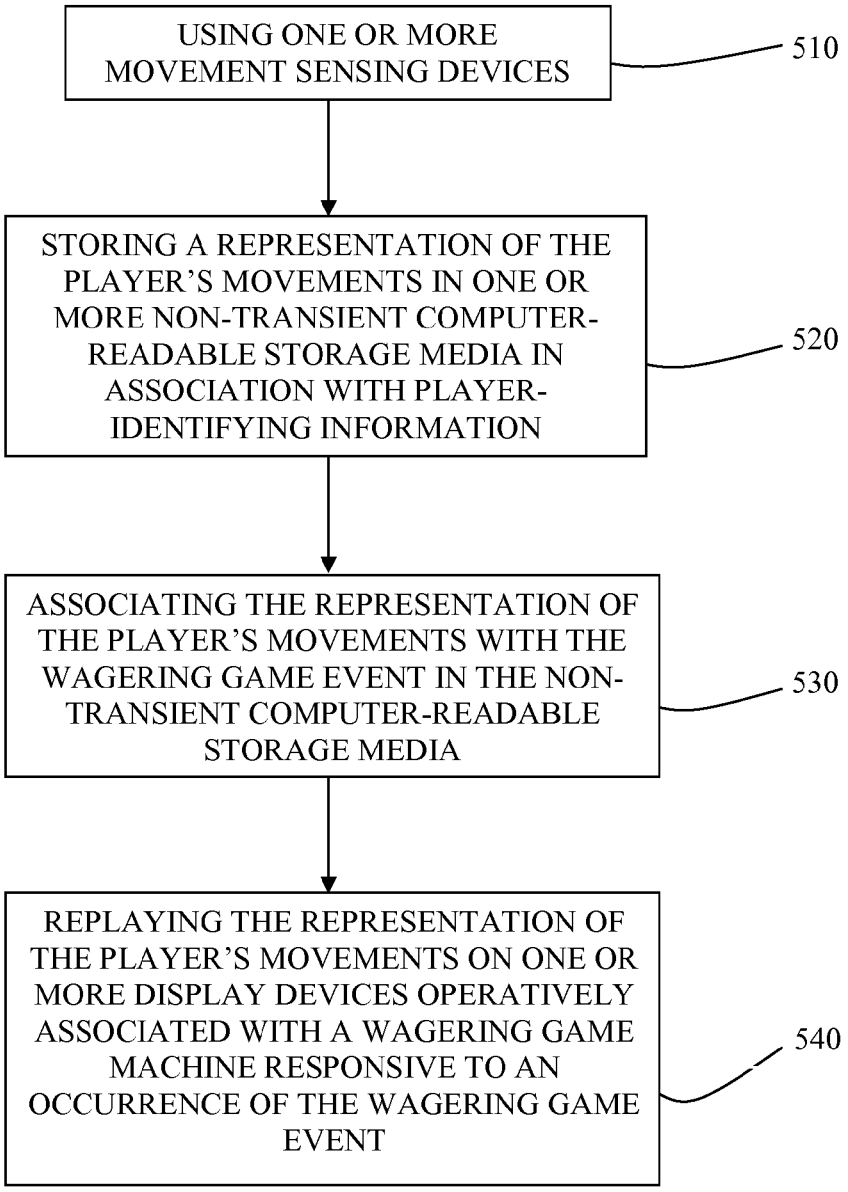
FIG. 5 is a flowchart of at least some acts in a method in accord with at least some aspects of the present disclosure.

FIG. 5, described by way of example above, represents one set of acts corresponding to at least some instructions executed by the CPU 30 in FIG. 2 to perform functions associated with the disclosed concepts. A method of utilizing a player's movements in association with a wagering game event, comprising the acts of sensing a player's movements using one or more movement sensing devices (act 510) (see, e.g., movement sensing devices 125 in FIG. 4), storing a representation of the player's movements in one or more non-transient computer-readable storage media in association with player-identifying information (act 520), associating the representation of the player's movements with the wagering game event in the non-transient computer-readable storage media (act 530) and replaying the representation of the player's movements on one or more display devices operatively associated with a wagering game machine responsive to an occurrence of the wagering game event (act 540). It is to be noted that, should the concepts be applied to player movements only during a single gaming session, the act of storing a representation of the player's movements in one or more non-transient computer-readable storage media in association with player-identifying information comprises, for example, storing such representation in association with either entered player data or storing such representation in association with the wagering game machine at which the player is situated.

As one example of utilization of player movements in accord with the present concepts, motions sensed by the local movement sensing devices 120, 125 disposed in, on or near the wagering game machine 10, can be optionally coupled to a motion-inducing device or haptic output device such as, but not limited to the WMS Gaming Sensory Immersion 2.0 Motion Chair System. When navigating a course like a bonus round in Aladdin & The Magic Quest™ and the player is on a magic carpet, the player's arm and body motions could alter the direction the motion chair moves to follow the player's movements to give the player a sense of control over the path the carpet flies and/or influence a display (e.g., the direction of their head and movement of their head alters the view window to permit manipulation of a displayed field of view).

As another example of utilization of player movements in accord with the present concepts, player movements sensed by the local movement sensing devices 120, 125 disposed in, on or near the wagering game machine 10, are optionally coupled to a gaming establishment customer service interface to enable selected real-time movements of a player at the wagering game machine to cause the controller to output to the gaming establishment customer service interface a corresponding request. For example, a player desiring a refill on his or her drink may hold up the empty glass and shake the empty glass, a movement picked up by the local movement sensing devices 120, 125, interpreted by the controller, and transmitted to the gaming establishment customer service interface to ensure timely service to the player. In another variant of the present concepts, a player's movements are stored and later integrated into a computer-generated character. A player's body geometry is sensed by the local movement sensing devices 120, 125 disposed in, on or near the wagering game machine 10, and the player's dimensions (e.g., height, arm length, leg length, joint spacing, etc.) are measured and the corresponding dimensions of the computer-generated character (e.g., height, arm length, leg length, joint spacing, etc.) are automatically normalized to match those of the player. Thus, when a player's stored skeleton movements are optionally grafted into the computer-generated player's skeleton, there is a direct dimensional correspondence. The process of sizing up the player using local movement sensing devices 120, 125 may require player interaction with the gaming machine 10, such as responding to requests to identify the joints and/or other key dimensional features of an image of the player (e.g., the game system displays an image of the player on the display and requires the player to touch the joints, to identify key areas of their own facial structure such as eyebrows, corners of the mouth, etc.). By way of example, software from Reallusion (www.reallusion.com) permits a user to take a photo and assist the software to defining joint and facial features, which then permits animation of an actor to move the lips and eyes based on a recorded voice.

Although the present concepts have been presented in relation to one wagering game machine, the present concepts are able to transcend individual wagering game machines and may be utilized across different wagering games and different wagering game establishments, as the data representing the player's movement(s) are adaptable to a plurality of different wagering game machines, including those that do not have movement sensing systems 120.

Each of these embodiments and obvious variations thereof is contemplated as falling within the spirit and scope of the claimed invention, which is set forth in the following claims. By way of example, also contemplated as being included within the present concepts are utilization of one or more electronic devices and/or markers (e.g., LED or IR markers) carried or worn by the player to enhance an ability of the movement sensing system to discern characteristics of the player's movement. These gestures can then be applied to an avatar or may be used as native data. Moreover, the present concepts expressly include any and all combinations and subcombinations of the preceding elements and aspects.

What is claimed is:

1. A method of utilizing a player's movements in association with a wagering game event that occurs after a wager to play a wagering game and during play of the wagering game, comprising:

sensing a player's movements using one or more movement sensing devices;

storing a representation of the player's movements in one or more non-transient computer-readable storage media in association with player-identifying information;

prior to an occurrence of the wagering game event, associating the representation of the player's movements with the wagering game event in the non-transient computer-readable storage media; and in response to the occurrence of the associated wagering game event, replaying the representation of the player's movements on one or more display devices operatively associated with a wagering game machine.

2. The method of claim 1, wherein the associating the representation of the player's movements with the wagering game event is responsive to a player input selecting which wagering game event is associated with the representation of the player's movements.

3. The method of claim 1, wherein the act of sensing the player's movements using one or more movement sensing devices utilizes at least one movement sensing device disposed remotely from the wagering game machine.

4. The method of claim 2, wherein at least one of the one or more movement sensing devices comprises at least one of a 3-D scanner, a 3D time-of-flight camera, a CMOS-based 3D time-of-flight camera, or a LIDAR device.

5. The method of claim 1, wherein the representation of the player's movements is associated with the wagering game event after the representation is stored in the non-transient computer-readable storage media.

6. The method of claim 1, further comprising, in response to a second occurrence of the associated wagering game event, replaying the representation of the player's movements on at least one of the one or more display devices operatively associated with the wagering game machine.

7. The method of claim 1, wherein the act of replaying the representation of the player's movements on the one or more display devices operatively associated with the wagering game machine comprises using an avatar to replay the representation of the player's movements.

8. The method of claim 1, wherein the associated wagering game event at the wagering game machine comprises a wagering game win event or a win celebration.

9. The method of claim 1, wherein non-monetary awards or items obtained in the wagering game are associated with the player's avatar, the player, or the representation of the player's movements.

10. One or more non-transitory, computer-readable storage media including instructions which, when executed by one or more processors, cause at least one of the one or more processors to perform operations comprising:

causing one or more movement sensing devices operatively associated with at least one of the one or more processors to sense a player's movements;

causing at least one of the one or more processors to store a representation of the player's movements in one or more non-transient computer-readable storage media in association with player-identifying information; and prior to an occurrence of a designated wagering game event after a wager to play a wagering game and during play of the wagering game, associating the representation of the player's movements with the designated wagering game event in at least one of the one or more non-transient computer-readable storage media for subsequent replay of the representation of the player's movements on one or more display devices operatively associated with a wagering game machine responsive to an occurrence of the designated wagering game event.

11. The one or more non-transitory computer-readable storage media of claim 10, wherein the designated:

wagering game event is a winning outcome of the wagering game.

12. A system for utilizing a player's movements in association with one or more wagering game events, comprising:

one or more movement sensing devices configured to sense a player's movements; and one or more controllers configured to:

cause the one or more movement sensing devices to sense a player's movements;

store a representation of the player's movements in one or more non-transient computer-readable storage media in association with both player-identifying information and the one or more wagering game events;

retrieve the stored representation of the player's movements from the one or more non-transient computer-readable storage media responsive to an occurrence of the one or more wagering game events; and display the stored representation of the player's movements on one or more display devices responsive to the occurrence of the one or more wagering game events.

13. The system for utilizing a player's movements in association with one or more wagering game events according to claim 12, further comprising:

a wagering game machine that includes the one or more display devices.

14. The system for utilizing a player's movements in association with one or more wagering game events according to claim 13, wherein the one or more non-transient computer-readable media storing the representation of the player's movements reside on a remote server and are connected to the wagering game machine via a communications network.

15. The system for utilizing a player's movements in association with one or more wagering game events according to claim 13, wherein movement sensing devices are disposed proximal the wagering game machine and sense the movements of the player at the wagering game machine.

16. The system for utilizing a player's movements m association with one or more wagering game events according to claim 12, wherein at least one of the one or more movement sensing devices comprises a 3-D scanner, a 3D time-of-flight camera, a CMOS-based 3D time-of-flight camera, or a LIDAR device.

17. The system for utilizing a player's movements in association with one or more wagering game events according to claim 12, wherein the representation of the player's movements includes a first avatar mimicking the player's movements responsive to an occurrence of a first wagering game event and a second avatar mimicking the player's movements responsive to an occurrence of a second wagering game event.

18. The system for utilizing a player's movements in association with one or more wagering game events according to claim 12, wherein the one or more controllers further:

cause the one or more movement sensing devices to sense another player's movements;

store a representation of the another player's movements in the one or more non-transient computer-readable storage media in association with another player-identifying information and a different one of the one or more wagering game events;

retrieve the stored representation of the another player's movements from the one or more non-transient computer-readable storage media responsive to an occurrence of the different one of the one or more wagering game events; and display the stored representation of the another player's movements on at least one of the one or more display devices responsive to the occurrence of the different one of the one or more wagering game events.

19. The system for utilizing a player's movements in association with one or more wagering game events according to claim 12, wherein the one or more controllers are configured to cause the one or more movement sensing devices to sense a player's movements prior to a start of play of the wagering game.

20. The system for utilizing a player's movements in association with one or more wagering game events according to claim 12, wherein the one or more controllers are configured to display the stored representation of the player's movements in response to at least two separate occurrences of one of the one or more wagering game events during a single play of the wagering game.

21. The system for utilizing a player's movements in association with one or more wagering game events according to claim 12, wherein the one or more controllers are configured to cause the one or more movement sensing devices to sense a player's movements responsive to an occurrence of at least one of the one or more wagering game events during play of a wagering game on a wagering game machine.

22. The system for utilizing a player's movements in association with one or more wagering game events according to claim 12, wherein the representation of the player's movements includes an avatar mimicking the player's movements.

23. The system for utilizing a player's movements in association with one or more wagering game events according to claim 12, wherein at least one of the one or more wagering game events comprises a wagering game win event.

24. The system for utilizing a player's movements in association with one or more wagering game events according to claim 12, wherein at least one of the one or more wagering game events on a wagering game machine comprises a wagering game event in which the player is not interacting with the wagering game via player inputs.

25. The system for utilizing a player's movements in association with one or more wagering game events according to claim 21, wherein the at least one of the one or more wagering game events on a wagering game machine comprises spinning one or more reels in a wagering game.

* * * * *